US005535491A

United States Patent [19]

Allport

[11] Patent Number: 5,535,491

[45] Date of Patent: Jul. 16, 1996

[54] TAG FASTENER

[76] Inventor: Douglas C. Allport, 202-3980 Carrigan Court, Burnaby, British Columbia, Canada, V3N 4S6

[21] Appl. No.: 237,878

[22] Filed: May 4, 1994

[30] Foreign Application Priority Data

May 7, 1993 [CA] Canada ..... 2095765

[51] Int. Cl.[6] ..... A44B 19/26

[52] U.S. Cl. ..... 24/429; 24/326; 24/704.1

[58] Field of Search ..... 40/1.5, 669, 665; 70/16; 24/16 PB, 704.1, 543, 326, 429, 431; 292/307 A, 308, 314, 318

[56] References Cited

U.S. PATENT DOCUMENTS

| | | | |
|---|---|---|---|
| 1,075,327 | 10/1913 | Browning | 40/665 |
| 1,530,680 | 3/1925 | Linden et al. | 40/665 |
| 1,952,085 | 3/1934 | Mayer | 40/665 X |
| 2,133,062 | 10/1938 | Thomson | 292/314 X |
| 3,146,012 | 8/1964 | King, Sr. | 24/168 PB X |
| 3,729,780 | 5/1973 | White | 24/543 X |
| 4,377,047 | 3/1983 | Adams, Jr. et al. | 40/665 |
| 4,512,093 | 4/1985 | Kolton et al. | 40/669 |
| 5,018,286 | 5/1991 | Zahner | 40/665 X |
| 5,159,728 | 11/1992 | Bingold | 70/16 X |

FOREIGN PATENT DOCUMENTS

| | | | |
|---|---|---|---|
| 330705 | 6/1930 | United Kingdom | 40/665 |

*Primary Examiner*—James R. Brittain
*Attorney, Agent, or Firm*—Cushman Darby & Cushman

[57] ABSTRACT

A fastener for retaining an article to an object, such as a ski pass hang tag to a ski jacket, said fastener comprising a body having first retaining means to non-releasably retain said article and second retaining means to non-releasably retain said object. Preferably the fastener is of unitary construction and formed of a resiliently flexible material such as nylon. The fastener provides for improved security, convenience, reduced litter and for the display of advertising material.

4 Claims, 7 Drawing Sheets

TAG FASTENER

FIELD OF THE INVENTION

This invention relates to fasteners for securing an article to an object, and particularly, to a fastener for securing hang tags to an object such as a person's garment, a mechanical shut-off device, electrical switching equipment and luggage.

BACKGROUND OF THE INVENTION

The ski industry presently uses an industry standard wire/label system for securing a lift pass, purchased by the skier, to the latter's outer ski garment. The wire of such a system is so shaped, typically in the form of a planar triangular frame with a split opening along the bottom of the triangle, so as to define an aperture which after being threaded through a closed mechanical loop on the skier's outer ski garment, such as a zipper eyelet or sewn in loop for such purpose, is covered by a self-adhesive label. When used properly, the label is folded in half over the wire, covering the opening along the bottom of the triangle and adhering to itself, adhesive to adhesive, permanently through and outside the wire aperture, thereby embracing the wire. The top of the triangle remains free and allowed to swing through the closed loop on the skier's garment. Removal of the pass should lead to complete destruction of the pass; a feature which is preferred by the ski areas to prevent transfer of the lift pass which would result in a loss of revenue to the ski area. However, a common practice of skills is to adhere one label over another, or in some cases insert a piece of the label peel off backing, thereby placing the self-adhesive backings in contact with a plastic or coated paper stock, to which it was not designed to adhere, particulary in extreme cold or hot conditions. In such cases the label has been known to fall off accidentally, and in many more cases, removed by the skier and transferred to a second non-paying skier.

The wire/label system presents a number of operational problems to the ski area operator, including a significant litter problem when skiers discard the label backing which becomes a third item to hang on to and an inconvenient obstacle when adhering the now detached label at sub-zero temperatures. Labels have also been a problem with new high speed printers that run at much higher heats, resulting in the label leaving the backing to which it is applied and causing label roll-up in the printer, further resulting in significant repair costs and down time of the printer. The wires, despite extraordinary packaging efforts to prevent such mishap, are difficult to present to the skier without tangling, similar to the handling of wire coat hangers. It has been estimated that as few as half of the wires purchased by the ski area will actually be used for the purpose of their purchase, with the balance left tangled in the snow until picked up by ski area staff, or thrown out by ski area staff after becoming entangled during the process of presenting them for the ski areas skiers.

A further note of the wire is that because of its rigidity, the wire when embraced by the label, may be cut in two below the surface of the label and still provide the skier with sufficient confidence it will not fall of, not be visibly noticeable by ski area security policing for such unacceptable and illegal activity, and have sufficient pull strength that when physically challenged by security policing for such unacceptable and illegal activity may go unnoticed. Such practice is used by thieves sharing the same single user pass.

Accordingly, it is an object of the present invention to provide a more secure, litter free, and easier to apply day pass system for ski areas, as well as for such uses as a "tagable seal" in mechanical and electrical safety lock out procedures, airline luggage tags, or other applications that require a secure means of fastening a specific hang tag to a specific object such as a person or device. Further, the fastener of this invention offers the ski area a lift pass system that includes a new revenue generating promotional opportunity when used with a perforated hang tag that includes a detachable coupon offer. In industrial practices, the detachable area of the hang tag may act as a receipt for the proof of use of the specific hang tag and would in most cases include a number that corresponds with a number that would remain with the section attached permanently to the fastener.

These and other objects will become apparent from a reading of this specification as a whole.

SUMMARY OF THE INVENTION

Accordingly, in its broadest aspect, the invention provides a fastener for fastening a first article to a second article, said fastener comprising a body having first retaining means to non-releasably retain said first article and second retaining means to non-releasably retain said second article.

While the first and second retaining means are, preferably, formed of resiliently flexible materials, more preferably, the fastener is of a unitary construction and fully formed of a resiliently flexible material.

The fastener is of particular use for fastening a hang tag such as a clothing hang tag, or ski pass hang tag or safety information hang tag to a garment or device per se or most preferably, through a rigid non-readily breakable member such as a zipper eyelet or typical day pass loop sewn into a ski garment. Thus, preferably, the fastener has a body having a substantially first portion having a first face to receive the ticket hang tag, and a second body portion having a second face. When the body is folded over to effect face to face opposing relationship between the first and second body portions, the ticket is non-releasably retained between the faces, when the two body portions are non-releasably engaged, one with other. Attempts to remove the hang tag will result in sufficient damage to the hang tag to make it unusable.

Examples of preferred first retaining means are constituted by the first body portion having an upstanding, preferably integrally formed stud engageable with an aperture formed in the second body portion.

The fastener according to the invention preferably has a planer portion adapted to receive advertising literature and the like for the display thereof. This planar portion also provides for the molding of a unique serial number into each unit that could be cross referenced with a numbered hang tag, providing an even superior level of security when used for such measures.

By the term "foldable" is meant that the fastener according to the invention is so formed as to allow the first body portion to face and substantially abut the second body portion in consequence of the resilient flexibility of the article when integrally formed of a resiliently flexible material, such as a plastics material; or where the article has hinged members permitting such foldability.

In one embodiment of the invention the second retaining means comprises an elongated member operably permanently attachable to a now secured hang tag and fastener combination to a person's garment, preferably through a rigid non-readily breakable member such as a zipper eyelet or day pass loop sewn into a ski garment. The diameter of such retaining means is limited to a size which will pass through a zipper eyelet, and because of its very small diameter is preferably made of a material having sufficient tensile and abrasive strength to endure the expected pulls and friction that can be expected during a number of subsequent ski days or in an outdoor industrial lock out situation. The small head area must also have sufficient resiliency to maintain a permanent catch when stressed. This second retaining means includes the elongated member which is of sufficient strength but not so strong that if cut, it will maintain the fastener and hang tag in place, and such that when the fastener is pulled in stress from the object to which it is fastened, it will stretch and eventually break before sufficient stress can be put on the rather small catch at its end.

BRIEF DESCRIPTION OF THE DRAWINGS

In order that the invention may be better understood, preferred embodiments will now be described by way of example only with reference to the accompanying drawings wherein.

Like numerals in the drawings represent the same or similar parts.

DETAILED DESCRIPTION OF THE PREFERRED EMBODIMENTS

Figure 1:
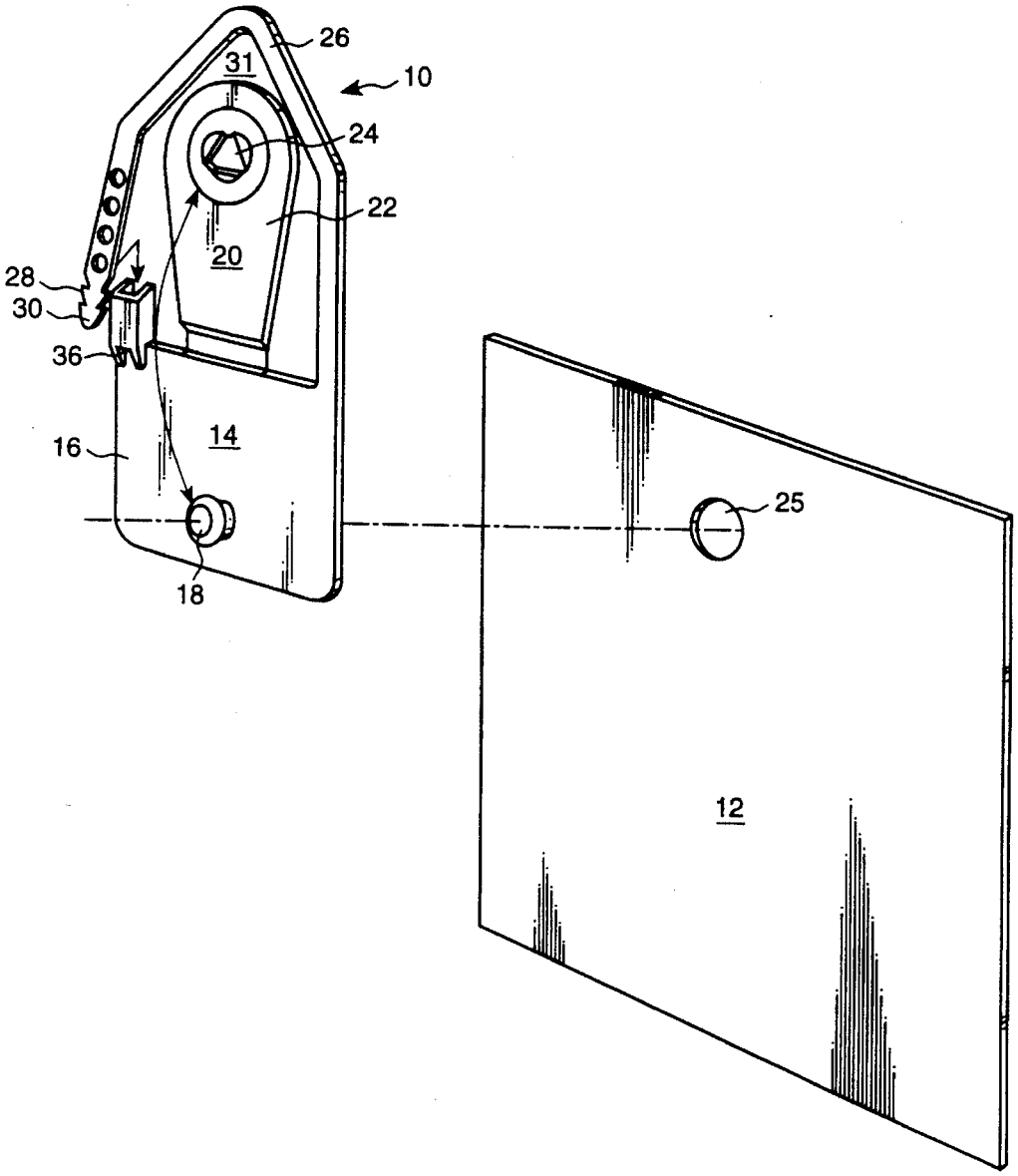
FIG. 1 represents a perspective view of a fastener according to the invention prior to receiving a hang tag and the hang tag.

With reference to the drawings, FIG. 1 shows a fastener 10 of approximately 2.5 cm in width, 5 cm in length and 1 cm in thickness, and formed of a plastics material in association with a ski or clothing tag or ticket 12 typically of about 8 cm in width and 10 cm in length. Fastener 10 has a body portion 14 having a planar front face 16 and a mushroom shaped stud 18, having three head supports, and perpendicularly upstanding therefrom. In the embodiment shown, stud 18 is integrally formed with body portion 14, but in alternative embodiments the stud may be received in either loose or tight-fitted engagement in an aperture defined by body portion 14. Stud 18 is so shaped as hereinafter described.

Fastener 10 also has a body portion 20 integrally formed with body portion 14, and is shown in FIG. 1 to be co-planer with portion 14. Body portion 20 has a front face 22 and a portion defining a stud receiving aperture 24 and is of a desired thickness and resilient flexibility as to allow folding thereof to permit faces 16 and 22 to substantially abut and oppose each other to define therebetween a tag receiving area or aperture.

Tag 12 has a portion defining an aperture 25 which operably receives stud 18. Upon receipt of tag 12, stud 18 engages aperture 24 in non-releasable engagement so as to permanently retain tag 12 between faces 16 and 22 of body portion 14 and 20, respectively. The resilient flexibility of the plastics material and the shape of the head of stud 18 and/or body portion defining the aperture allows of and provides a one time, one way passage of stud 18 through aperture 24. Stud 18 and aperture 24 are further so shaped as to prevent ready cutting of stud 18 from fastener 10.

In alternative embodiments, body portion 14 may define a stud receiving aperture while body portion 20 has a perpendicularly, upstanding cooperable stud receivable by this aperture to effect similar, non-releasable retention of a tag ticket.

Figure 2:
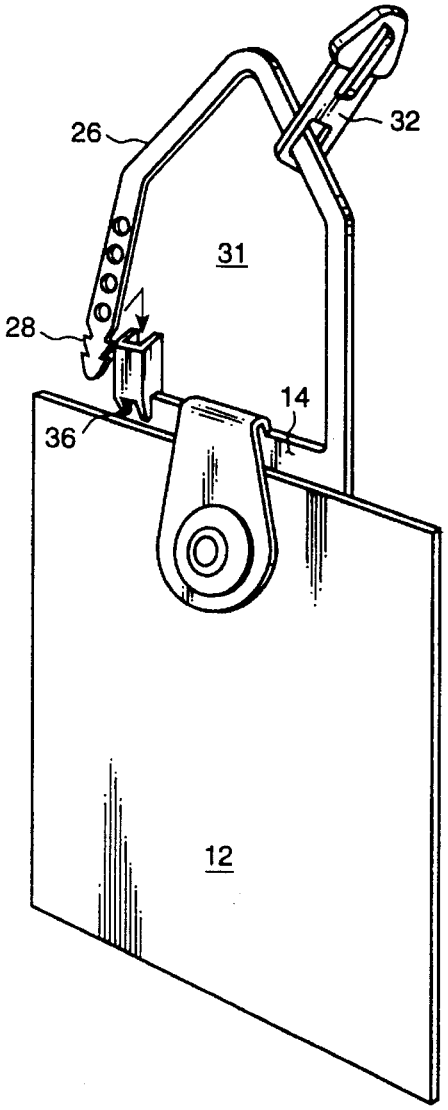
FIG. 2 represents a perspective view of a fastener acceding to the invention in a folded-over position to retain a ski tag in association with a clothing zipper in an open position.
Figure 3:
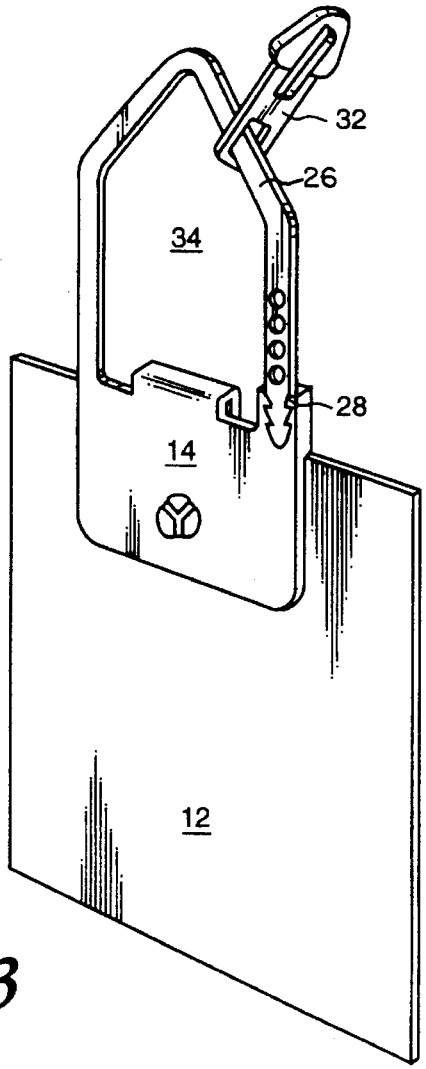
FIG. 3 represents a perspective rear view, partly cut away, of a fastener and tag of FIG. 2 in association with a clothing zipper in a closed position.

With reference also now to FIG. 2 and FIG. 3, integrally formed with body portion 14 is an elongate member 26 having a plurality of arrow-head projections 28, longitudinally of member 26 at a terminal portion 30, thereof. Elongate member 26 as shown in FIG. 2 substantially defines an open-ended loop 31 to operably receive a closed zipper member 32 and subsequently defines a closed aperture 34 when engaged as shown in FIG. 3. FIG. 3 shows zipper member 32 and elongate member 26 in interlocking relationship.

Figure 4:
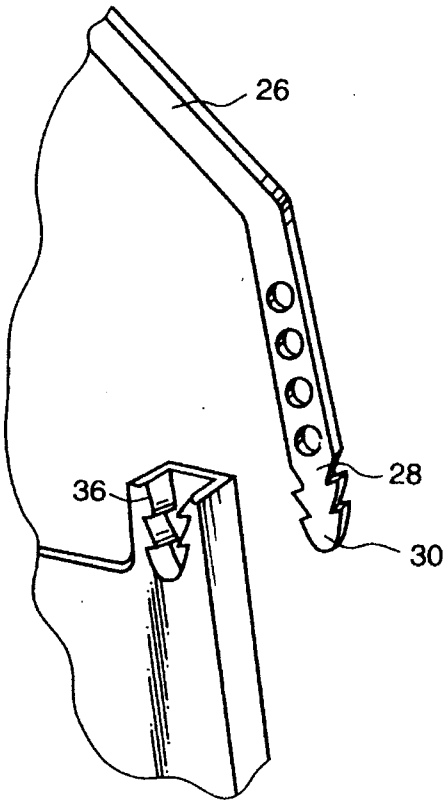
FIG. 4 represents a perspective view of a partly cut away retaining means of use in a fastener according to the invention.

In more detail, and with reference to FIG. 4, body portion 14 has a portion 34 defining a serrated, substantially cylindrical aperture 36 complimentary to terminal portion 30 to operably allow aperture 36 to receive portion 30 in male-female interlocking non-releasable engagement to effect retention of zipper member 32 to fastener 10.

The fasteners may be formed, preferably, by injection molding or casting of a thermoplastics material, such as polypropylene, polyethylene, or a nylon, most preferably nylon 6, in a suitably formed mold. However, alternative methods of manufacture may be employed. While a thermoplastic material is preferably used as the material of construction of the fastener, as either a unitary, integrally formed article or combination of distinct members, other materials having the desired resilient flexibility such as aluminum and other metals may be used.

Figure 5:
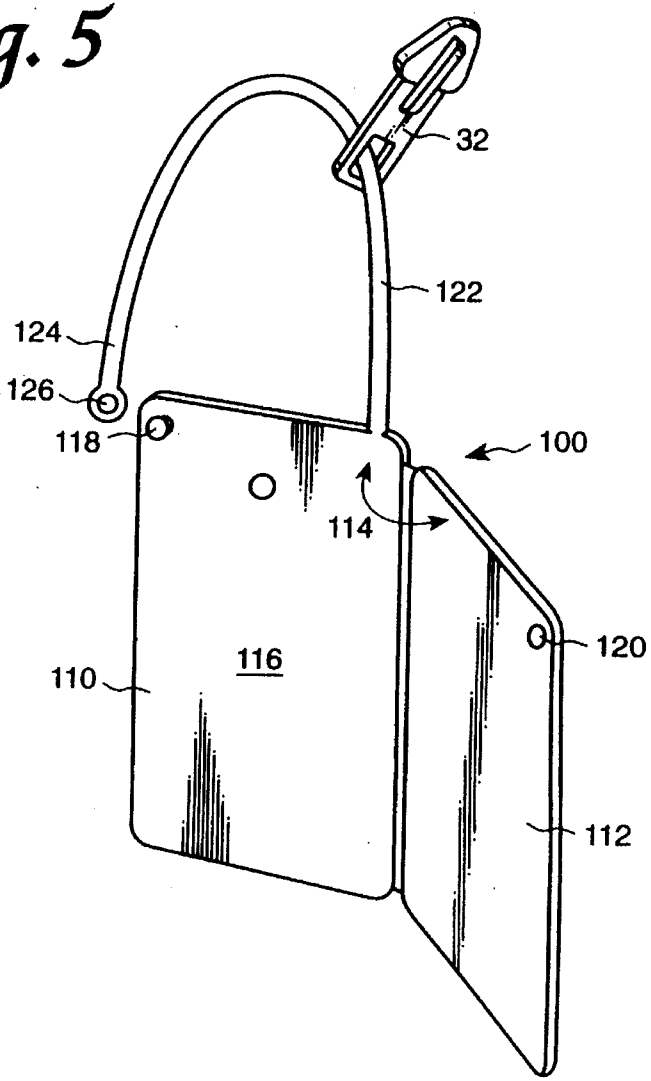
FIG. 5 represents an alternative embodiment of a fastener according to the invention.

FIG. 5 shows an alternative embodiment 100 formed of a pair of rectangularly shaped planar members 110, 112 operably superimposable one above the other to define a ticket receiving aperture 114. Members 110 and 112 are integrally formed of a resiliently flexible plastics material, such as polyethylene, to allow of such superimposition.

Alternatively, members 110 and 112 may be hinged one to the other.

Member 110 has a face 116 from which extends an upstanding stud 118, so shaped as hereinafter described. A portion of member 112 defines an aperture 120 which is complimentary to and operably receives stud 118, in non-releasable engagement. This stud 118—aperture 120 retaining means may be shaped as described with reference to FIGS. 1–3.

Integrally formed with member 110 is an elongated member 122 having a terminal portion 124 defining an aperture 126 so shaped as to also receive in non-releasable engagement stud 118. Superimposing members 110, 112, one upon the other and effecting retention of stud 118 in aperture 126 effects retention of portion 124 in a non-releasable manner.

Figure 6:
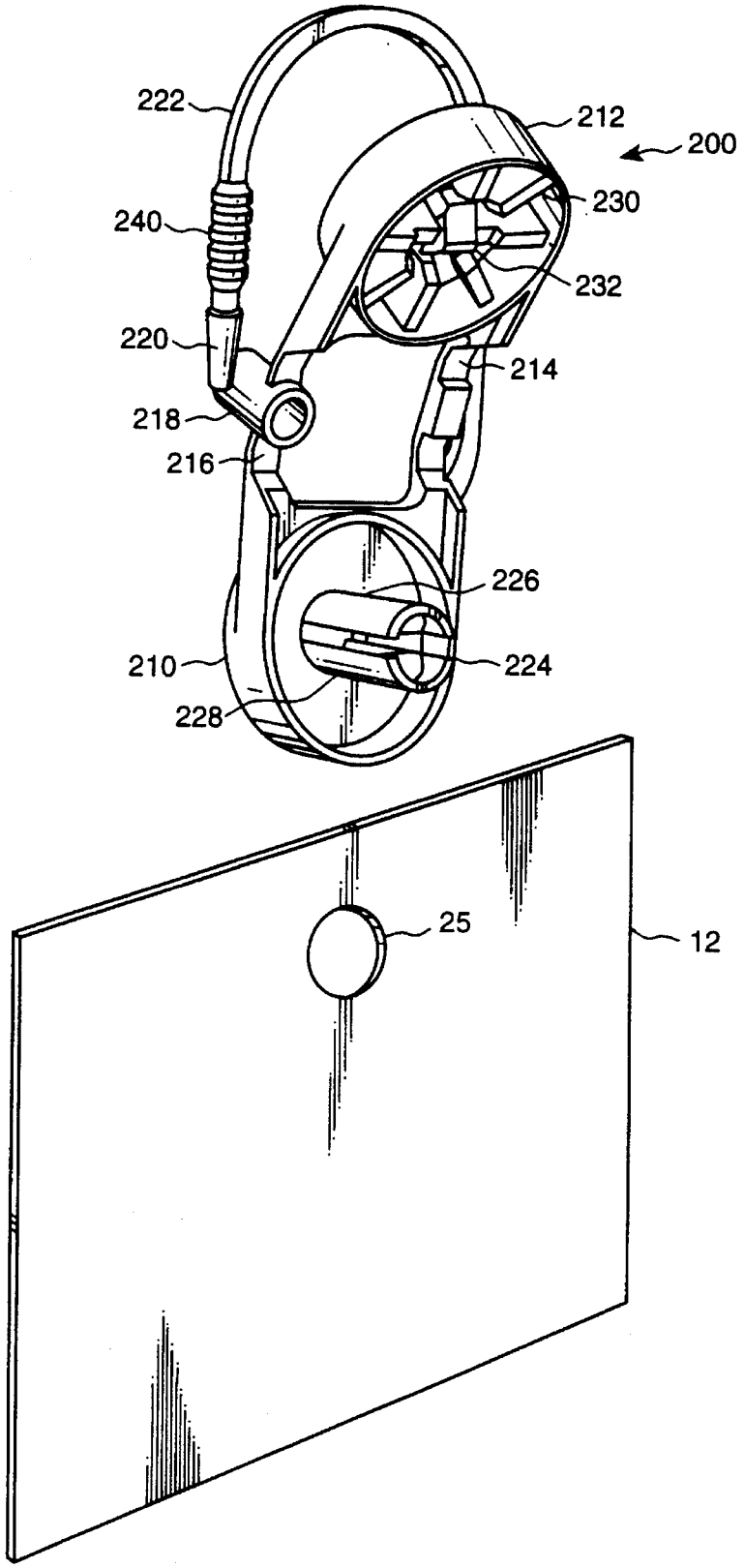
FIG. 6 represents a perspective view of an alternative fastener of the invention shown in an unlocked, substantially co-planar form, with a hang tag.

FIG. 6 shows a fastener of a unitary construction formed of Nylon 6. Fastener 200 has two integrally formed disc-like members 210, 212, bridged one to the other by arms 214, 216. Arm 216 has an upstanding open cylinder 218 adapted to receive a cone shaped terminal portion 220 of elongated member 222 as is more clearly shown in FIG. 7 in non-releasable interlocking engagement, as hereinafter described.

Member 210 has a perpendicularly upstanding split-stud 224, consisting of a two-part unit of semi-cylindrical open form, each of which parts 226, 228 are separated by a first distance at an upper part which decreases at a preferred rate to a narrower second distance before sharply increasing to a greater distance for the balance of the lower part to its point of adjoinment with member 210. The flexible resilience of stud 224 allows upper portion of 226 and 228 to be temporarily deformed. Split stud 224 in the above embodiment is conveniently guided and located and, once engaged, be secured in the locked folded fastener in a close tolerance fit by the presence of guides 230 on member 212.

Figure 8:
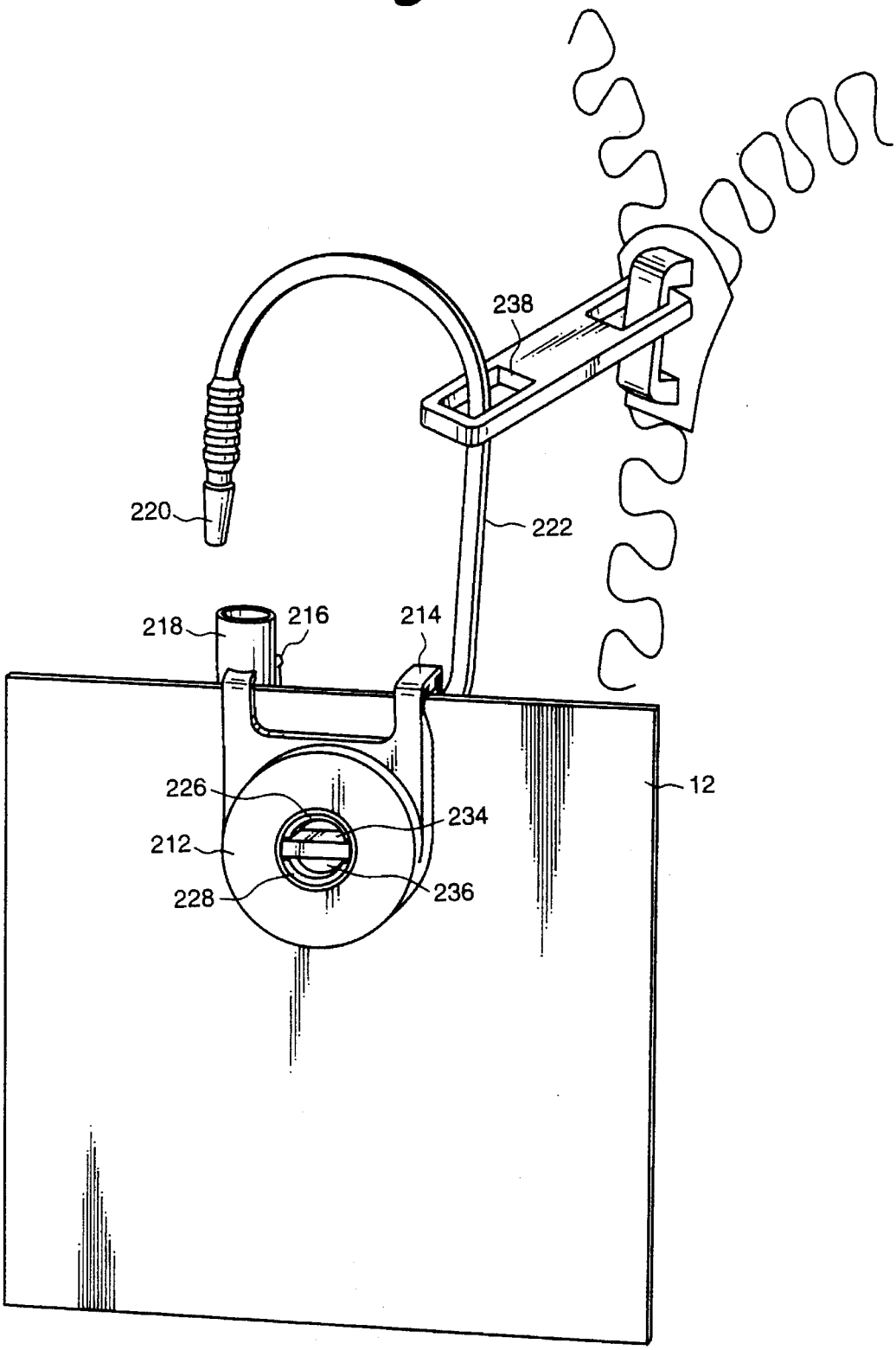
FIG. 8 represents a perspective view of the fastener of FIG. 6 in a folded over hang tag locked engagement position embracing the hang tag.

Member 212 has a centrally deposited arrow-headed member 232, which with member 212 defines two semi-circular recesses 234,236 adapted to receive split-stud 224 in non-releasable engagement when fastener 200 is folded, substantially member 212 over member 210. The arrow head of member 232 displaces parts 226 and 228 which in turn flex the arrow head of member 232, and in so doing provides for the passage of arrow head 232 through the sloped narrower section of parts 226 and 228 to the lower part of a greater separating distance to effect return of parts 226 and 228 to their original separated distance, and arrow head 232 back to its formed and preferred shape. This closed state is shown in FIG. 8 and more clearly in FIG. 9. This action effects non-releasable engagement of members 210 and 212. As shown in FIG. 8 such closure of members 210 and 212 effects entrapment of hang tag 12 when split-stud 224 is received by aperture 14 of hang tag 12 to provide proper location and convenient holding means from hang-tag 12.

Elongated member 222 is threaded through a zipper eyelet 238 of a ski jacket (not shown) and, terminal portion 220 enters cylinder 218 and is retained therein, entrapping zipper through its eyelet, 238.

Figure 7:
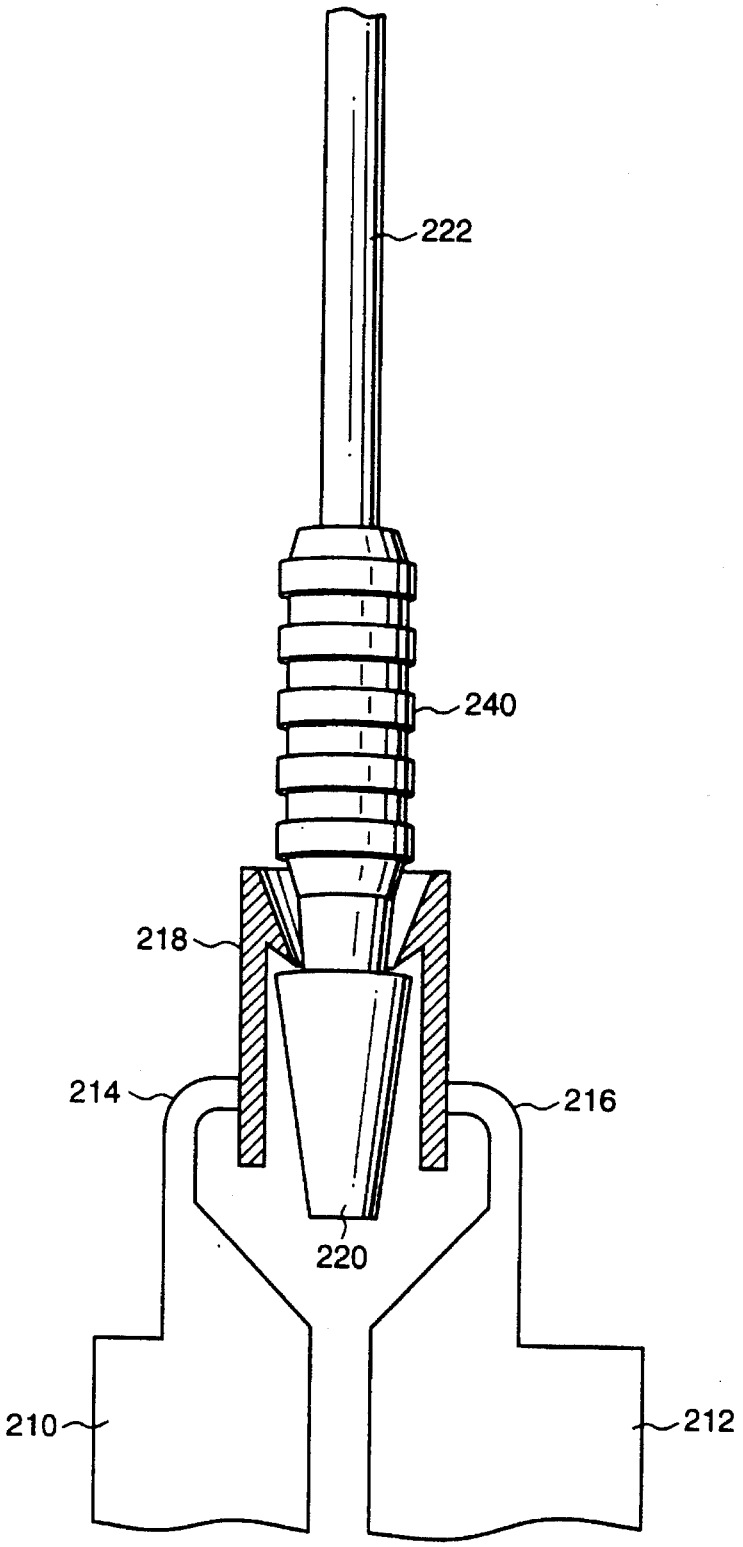
FIG. 7 represents a diagrammatic sectional view in part of a fastener means of use in the invention.

Fastener 200 is of approximately 2.5 cm in width 5 cm in length and 1.5 cm in thickness. Arms 214 and 216 are of sufficient dimensions as to allow folding thereof to permit members 210 and 212 to substantially align, abut and engage each other, while reorienting cylinder 218 to be co-planar with combined members 210, 212 to facilitate proper positioning of it for receiving terminal portion 220. Cylinder 218 has a series of inner pliable tabs of a desired thickness as to provide a one way passage of head of terminal 220 as shown in FIG. 7, Grip area 240 of elongated member 222 is formed to a greater width than the inside diameter of open cylinder 218, so as to prevent further passage of elongated member 222 through the open cylinder 218, once pushed sufficiently far enough to be permanently retained.

Elongated member 222 is formed of a desired thickness profile as to be pliable that in the event of being cut, it will cause fastener 200 to have insufficient strength to hold itself and hang tag 12 from such an object as zipper 238. Elongated member 222 is also of such desired thickness, profile and plastics material so as to stretch and eventually break before terminal portion 220 would break away and be released from cylinder 218. Further, elongated member 222 allows for ready cutting by scissors when so desired. Elongated member 222 may also be of such material and dimension that when stretched it will reduce the stress on the terminal portion 220—cylinder lock 218 and, in fact, break before such catch will release. Yet further, elongated member 222 is formed of a pliable material that when cut has insufficient strength to secure the hang tag under normal use and presents evidence of such tempering when so stretched.

Split stud 224 is so split into two to allow for the passage of arrow headed member 232 and also to allow flexing upon insertion of member 232 so as to more easily align entry and to take some of the stress of the interference phase of member 232 passing through barbs of stud 224.

In alternative embodiments, split stud 224 may be defined as a mushroom shape stud receivable by an aperture defined by a resilient material that will allow for a one way passage.

Figure 9:
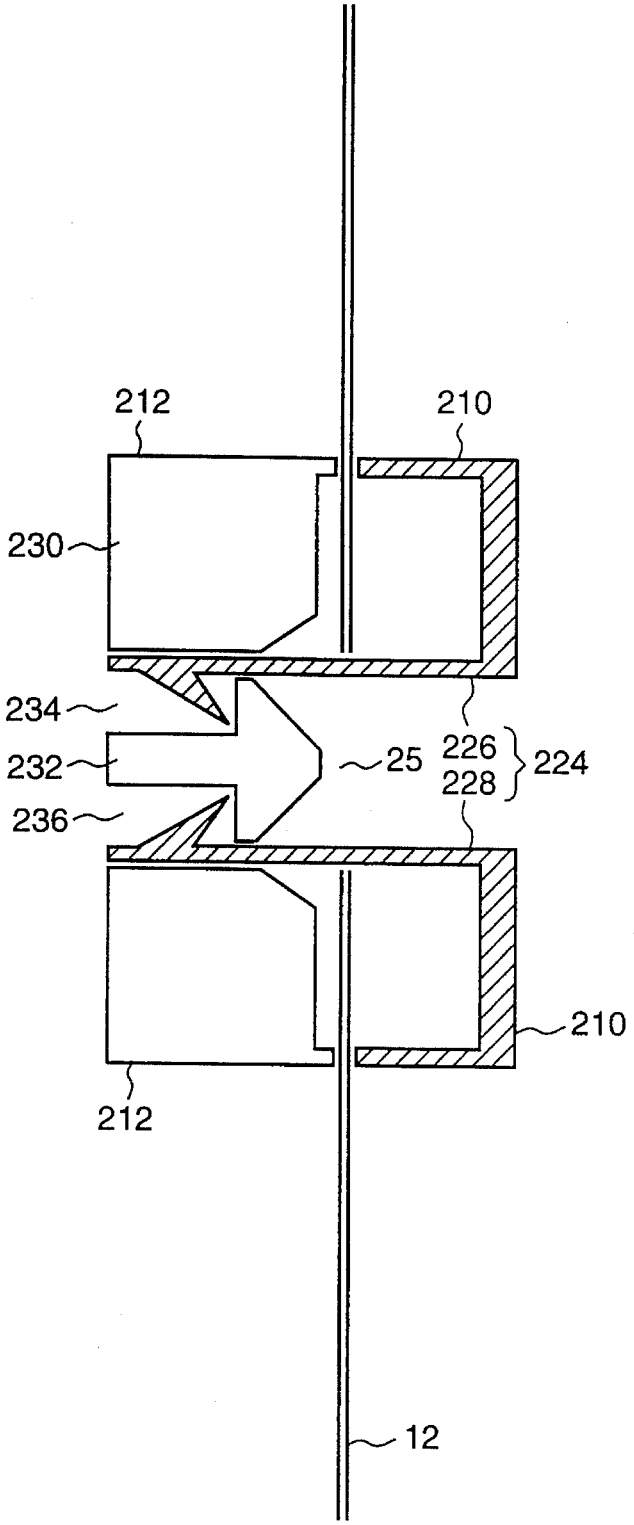
FIG. 9 represents a diagrammatic sectional view in part of an alternative fastener means of use in the invention embracing a hang tag.

The fasteners of the invention are so designed as to preferably provide little or no tolerance around the hang tag when permanently engaged between the two opposing faces of the two body portions embracing the hang tag. This is to reduce the risk of tampering. In this embodiment, each of the opposing faces also include a thin lip on the outermost diameter as seen in FIG. 9, of a sufficiently pliable material that is so designed as to give way when plied against with a mechanical device, such as a screw driver, that is slipped between the first and the second faces adjacent the hang tag.

While preferred embodiments of the invention have been described above, it will be recognized and understood that various modification may be made therein and the appended claims are intended to cover all such modifications which fall within in the spirit and scope of the invention.

I claim:

1. A fastener for retaining a first article to a second article, said fastener being of unitary construction and integrally formed of a resiliently flexible plastics material, said fastener comprising:

a substantially planar first body portion having a first face and a first upstanding member on said first face;

a substantially planar second body portion connected to said first body portion via a hinge portion, said second body portion having a second face and a portion defining a first aperture adapted to receive said first upstanding member in non-releasable engagement;

wherein said fastener is foldable about said hinge portion so as to allow said first face to oppose said second face to define a first article receiving area and effect non-releasable engagement of said first upstanding member with said first aperture;

an elongated member having a terminal portion defining a second aperture non-releasable engagement means, a second aperture adapted to receive said terminal portion in non-releasable engagement, said elongated member being adapted to receive said second article in interlocking engagement prior to said terminal portion and said second aperture engagement;

and wherein said elongated member is constructed and arranged such that when said terminal portion and said second aperture are engaged, application of force to said elongated member effects deformation of said elongated member without breakage of said terminal portion and said second aperture engagement.

2. The fastener according to claim 1, wherein said terminal portion of said elongated member is constructed and arranged to engage said second aperture in generally coplanar arrangement with said engaged said first and said second body portions.

3. The fastener according to claim 1, wherein said second aperture is disposed generally at said hinge portion.

4. A fastener in combination with a planar article, the fastener being constructed and arranged to retain the planar article to a second article, the fastener being of unitary construction and integrally formed of a resiliently flexible plastics material, said combination comprising:

a planar article; and a fastener comprising:

a substantially planar first body portion having a first face and a first upstanding member on said first face;

a substantially planar second body portion connected to said first body portion via a hinge portion, said second body portion having a second face and a portion defining a first aperture adapted to receive said first upstanding member in non-releasable engagement;

wherein said fastener is foldable about said hinge portion so as to allow said first face to oppose said second face to define a planar article receiving area and effect non-releasable engagement of said first upstanding member with said first aperture so as to retain said planar article between said first and second body portions;

an elongated member having a terminal portion defining a second aperture non-releasable engagement means, a second aperture adapted to receive said terminal portion in non-releasable engagement, said elongated member being adapted to receive said second article in interlocking engagement prior to said terminal portion and said second aperture engagement;

and wherein said elongated member is constructed and arranged such that when said terminal portion and said second aperture are engaged, application of force to said elongated member effects deformation of said elongated member without breakage of said terminal portion and said second aperture engagement.

* * * * *